United States Patent [19]

Aoyagi

[11] Patent Number: 4,759,141

[45] Date of Patent: Jul. 26, 1988

[54] DISPLAY SHEET APPARATUS

[76] Inventor: Youhitirou Aoyagi, 1200-3 Befukatamine, Simemachi, Kasuyagun, Fukuoka-ken, Japan

[21] Appl. No.: 874,658

[22] Filed: Jun. 16, 1986

[30] Foreign Application Priority Data

| | | | |
|---|---|---|---|
| Jun. 18, 1985 | [JP] | Japan | 60-132653 |
| Feb. 25, 1986 | [JP] | Japan | 61-25949[U] |
| Feb. 26, 1986 | [JP] | Japan | 61-43434 |

[51] Int. Cl.[4] ..... G09F 9/00

[52] U.S. Cl. ..... 40/488

[58] Field of Search ..... 40/488, 486, 489, 490, 40/491

[56] References Cited

U.S. PATENT DOCUMENTS

| | | | |
|---|---|---|---|
| 786,334 | 4/1905 | Wood | 40/488 |
| 2,117,186 | 5/1938 | MacLaren | 40/488 |
| 3,430,371 | 3/1969 | Phillips | 40/486 |
| 3,430,372 | 3/1969 | Rutchick | 40/486 |

FOREIGN PATENT DOCUMENTS

| | | | |
|---|---|---|---|
| 643923 | 7/1962 | Canada | 40/486 |

*Primary Examiner*—Gene Mancene

*Assistant Examiner*—J. Hakomaki

*Attorney, Agent, or Firm*—Bruce L. Adams; Van C. Wilks

[57] ABSTRACT

A stationary display member is mounted on a display apparatus and provided with a plurality of slots which communicate between front and rear faces of the stationary display member and which are disposed in parallel to and equally spaced a given interval from each other. A movable display member is mounted on the rear face of the stationary display member and comprised of a plurality of segments successively disposed on one another in a partially overlapped relation. Each segment has a width more than twice the slot interval such that about a half portion thereof is covered by the adjacent segment. The uncovered remaining segment portions are slidably inserted into the respective ones of the slots. A linear motor drives the movable display member to project the uncovered segment portions from the slots to change display.

6 Claims, 7 Drawing Sheets

DISPLAY SHEET APPARATUS

BACKGROUND OF THE INVENTION

The present invention relates to a display sheet having variable display surfaces.

Conventional display sheet having variable display surfaces includes a stationary display sheet having parallel slits through which an insert sheet having another display projects to change display. Such a display sheet is described in Japanese Patent Publication No. 500020/1984, and International Patent Publication No. W08/302517. Such a insert sheet is made of paper or fabric so that it is easily sagged or is arrested by the edge of the slit to disturb smooth operation. Also, the known display sheet can not change display for more than three sorts regularly.

The object of the present invention is to provide an improved display apparatus which can smoothly effect the display change of preferably more than three kinds of displays.

SUMMARY OF THE INVENTION

The broadest feature of the present invention is as follows:

According to the invention, the display apparatus of the type described comprises a plurality of insert sheets, each having a width more than twice the interval between adjacent slits provided on a stationary display sheet, upper and lower ends of each insert sheet being connected to upper and lower support members through narrow neck portions, respectively, such that each insert sheet is partially overlapped by an adjacent insert sheet in a half-duplicated manner. A first guide rod is secured with the stationary sheet for guiding the upper support member and a second guide rod is biased by spring means for guiding the lower support member.

As described, a desired number of insert sheets e.g. six, can be inserted between a rear surface of the stationary display sheet and a guide leaf which is practically an extension of the slit edge. Thus, smooth projecting and retracting movements of a selected insert sheet can be easily performed. When the insert sheet is projected through the slit, the original display on the stationary sheet is covered by a new display on the insert sheets. When the insert sheet is retracted through the slit, the original display reappears.

According to a preferred embodiment, the movable display sheet is driven to and fro by a linear motor, the linear displacement of which is controlled by a limit switch.

DETAILED DESCRIPTION OF THE PREFERRED EMBODIMENT

Figure 1:
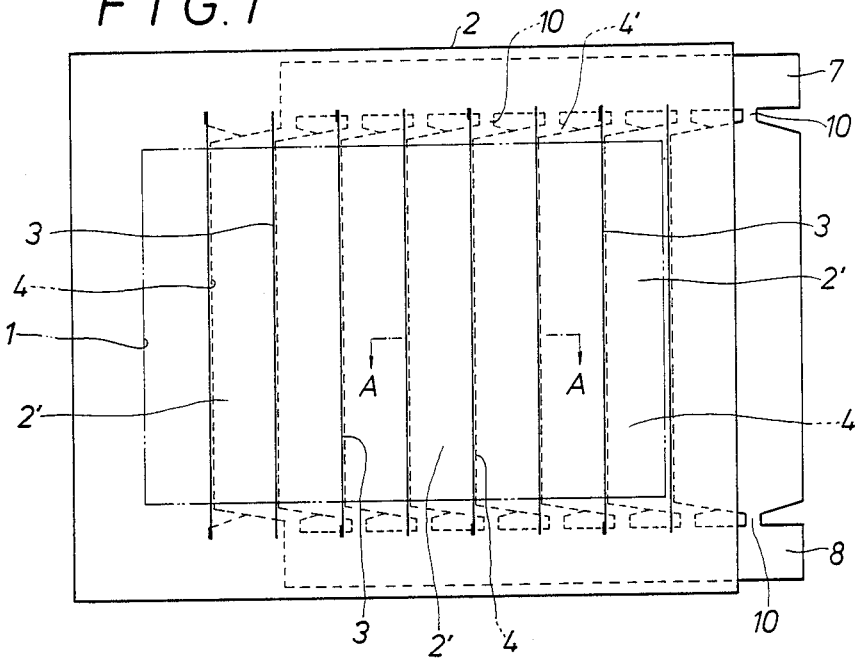
FIG. 1 is a front elevation of a display apparatus according to the present invention.
Figure 2:
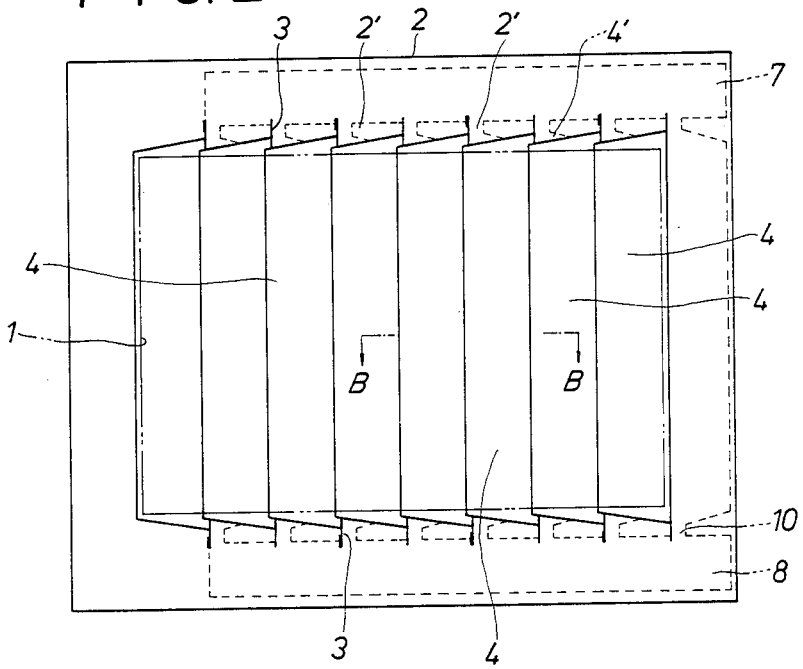
FIG. 2 is a front ellevation of the apparatus shown in FIG. 1 showing a display change.

FIGS. 1 to 5 show a display sheet according to a first embodiment of the present invention. On a rear side of a display frame 1, a stationary display sheet or member 2 having display scene, e.g. picture or words for advertisement, is supported. The stationary sheet 2 is provided with a plurality of vertical slits or slots 3 which are disposed in parallel to and equally spaced a given interval from each other. One side of each sheet portion 2' between the adjacent slits 3 is extended along a spaced rearside of the adjascent sheet portion 2' to form a guide leaf 2'' for one or more insert sheets 4.

Figure 3:
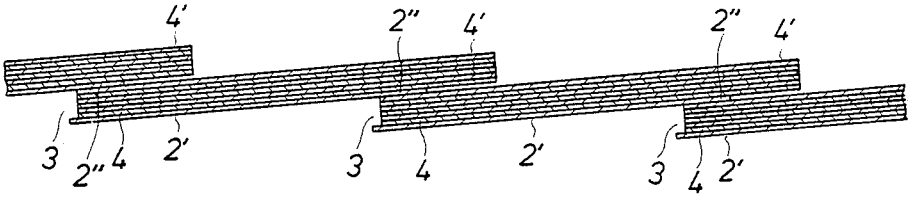
FIG. 3 is an enlarged partial sectional view taken along line A—A of FIG. 1.
Figure 4:
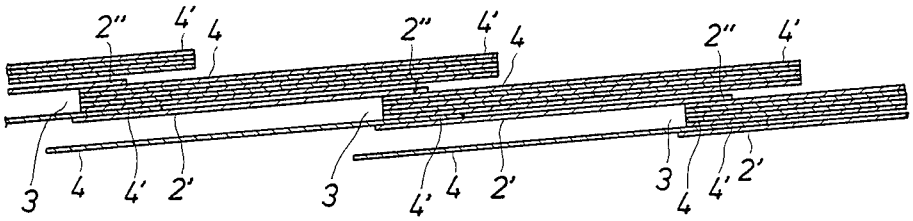
FIG. 4 is an enlarged sectional view taken along line B—B of FIG. 2.
Figure 5:
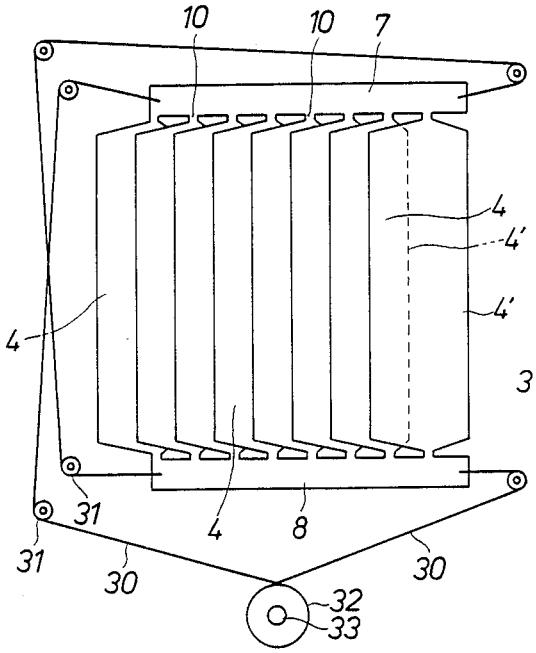
FIG. 5 is a front elevation of drive means of a movable display sheet.

A plurality of the insert sheets or segments 4 having a width more than twice the slit interval are successively disposed on one another in partially overlapped relation; as shown in FIG. 5, to be half duplicated each other and are connected by upper and lower narrow connecting pieces 10 to upper and lower slide members 7 and 8 to form an insert sheet assembly or movable display member 12. The left edge of each insert sheet 4 is placed between the guide leaf 2'' and overlapped sheet portion 2' of the display sheet 2. Thus, when the insert sheet assembly 4' is pulled leftwards in FIG. 1, the uncovered left portion of the insert sheet 4 appears through each slit 3 of the display sheet 2 until the whole front surface of the display sheet 2 is covered or concealed by the insert sheet 4. At this time, the display scene is changed to a new display scene. A plurality of the insert sheet assemblys 12 may be inserted between the guide leaf 2'' and the sheet portion 2' as shown in FIGS. 3 and 4, so that a desired insert sheet assembly 12 can be pulled from the slits 3 to change display on the surface as shown in FIG. 4. Consequently, display on the surface shown in FIG. 1 can be changed more than two kinds.

The upper and lower slide members 7 and 8 are suitably guided to slide along the frame 1. The insert sheet assembly 12 is moved by suitable means. In the embodiment shown in FIG. 5, strings 30 are connected to the slide members 7 and 8 at one ends thereof and are wound around a roller 32. The roll 32 can be selectably driven by suitable drive means 33.

FIGS. 6–11 show another embodiment of the present invention in which same reference numeral is used to show similar part with the first embodiment for sake of clarity.

Figure 6:
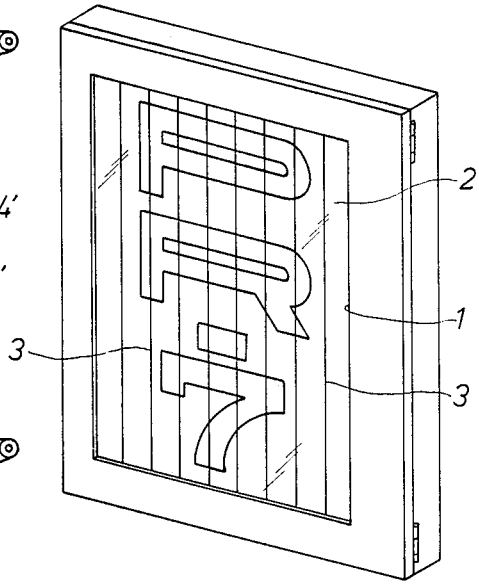
FIG. 6 is a perspective view of the display apparatus.

On an inner periphery of a frame 1, an outer edge of a display sheet is secured to form a stationary display sheet 2 as shown in FIG. 6. The display sheet 2 is provided with a plurality of vertical and parallel slits 3 at the same interval. Each sheet portion 2' between the adjacent slits has a guide leaf 2'' as descrived in the first embodiment. A plurality of insert sheets 4 are placed behind the slits 3. The insert sheets 4 are connected to upper and lower support plates 7' and 8' through narrow neck portions 10 so as to duplicate or cover about half the width of the adjacent insert sheet 4.

Figure 7:
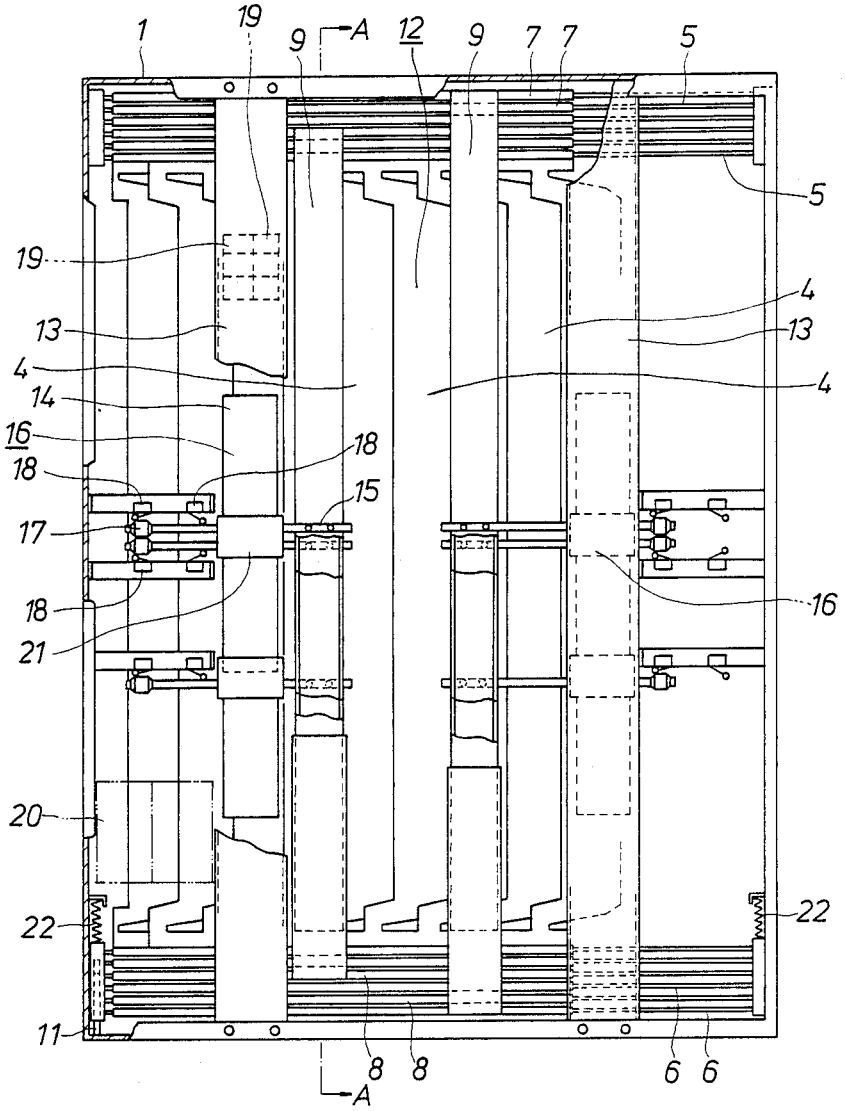
FIG. 7 is a rear side view of a display apparatus according to another embodiment of the invention.
Figure 8:
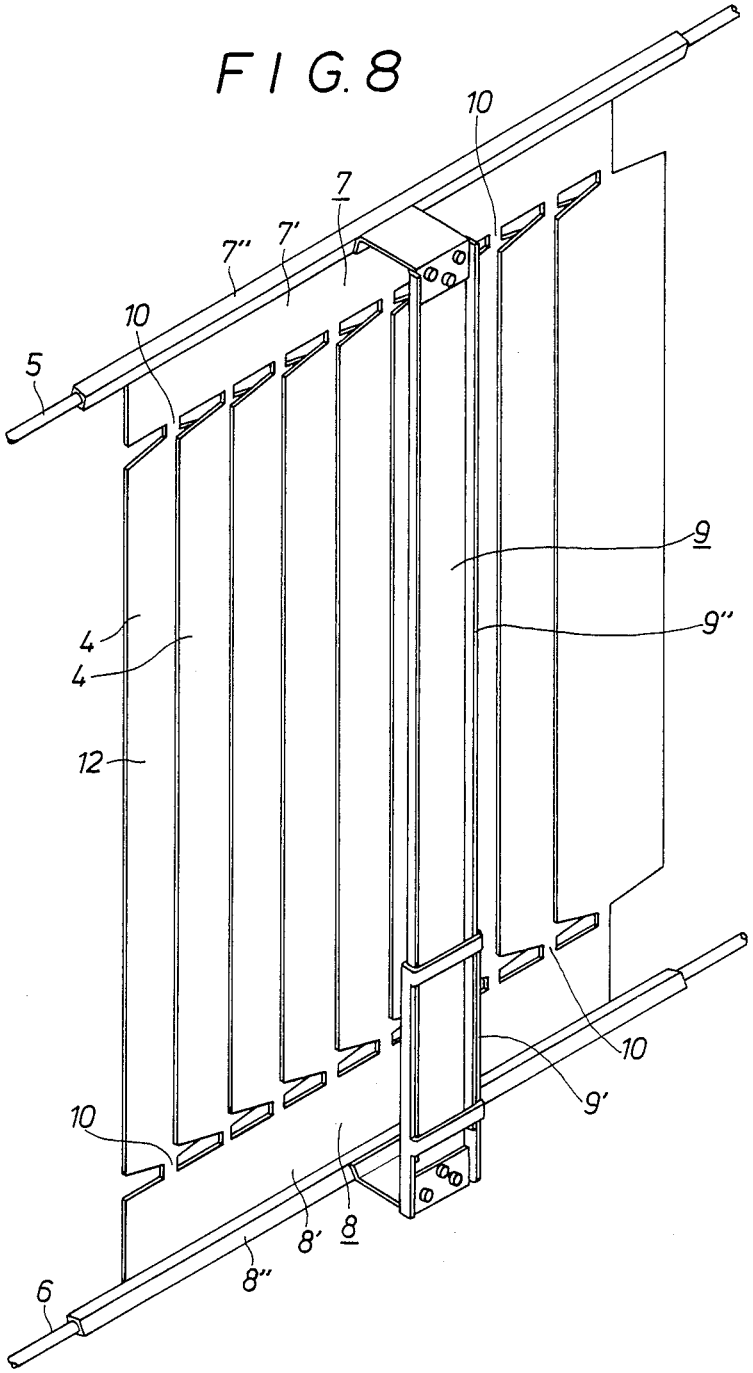
FIG. 8 is a perspective view of a movable display sheet.
Figure 9:
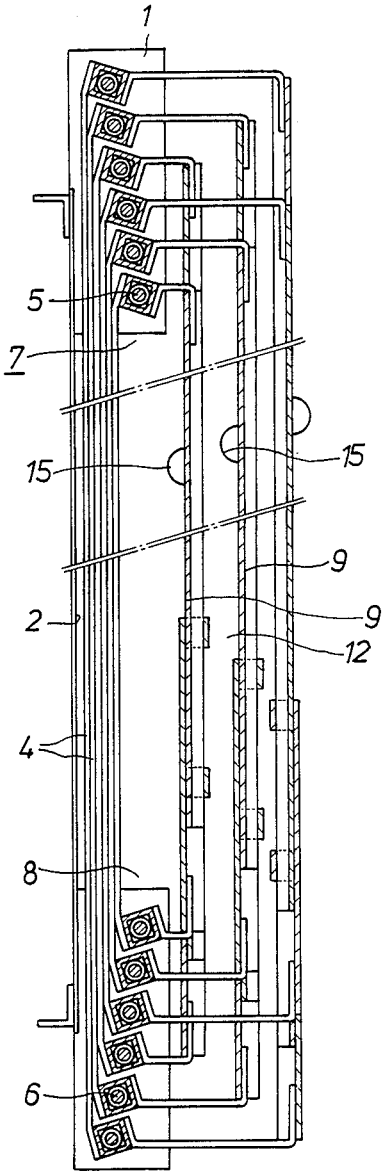
FIG. 9 is a sectional view taken along line A—A of FIG. 7.
Figure 10:
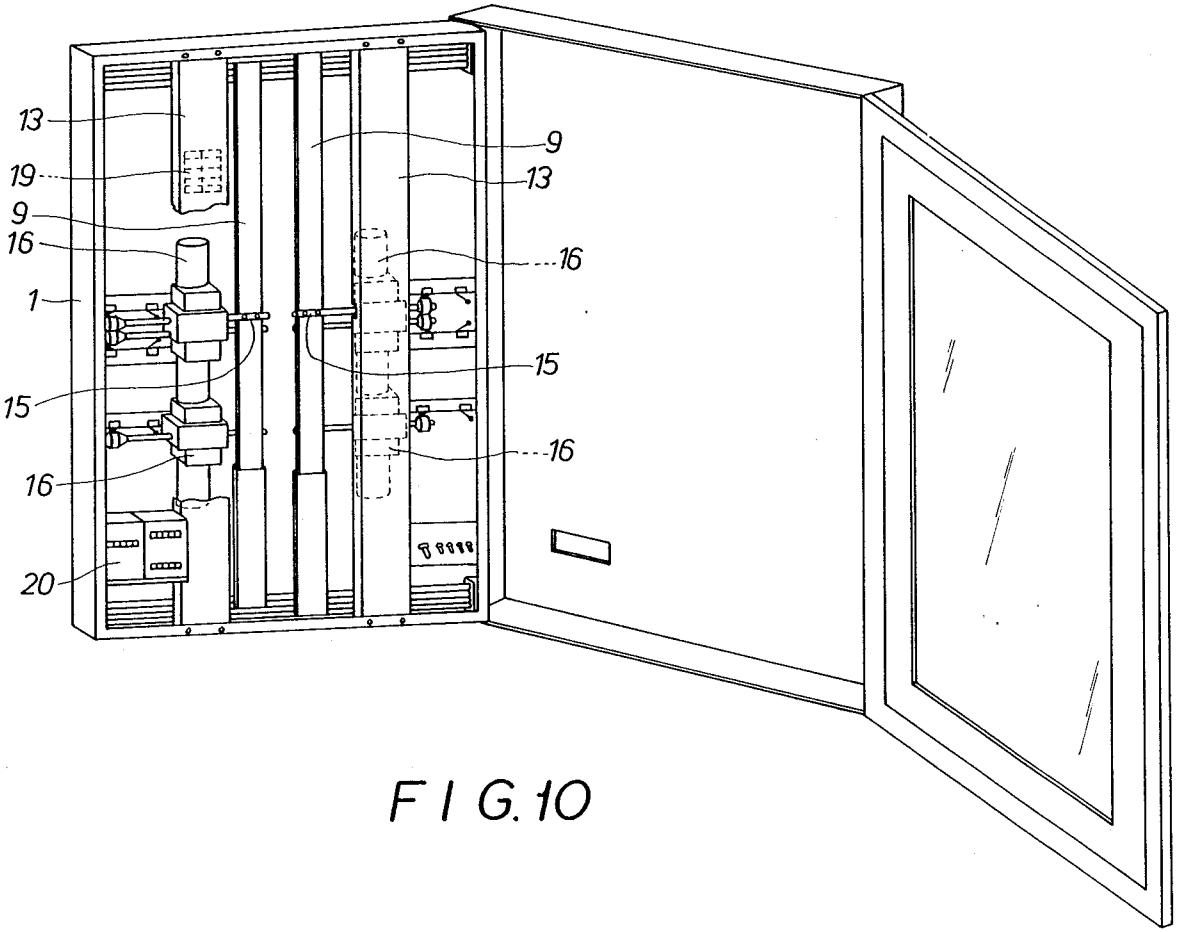
FIG. 10 is a developed view of the display apparatus.

The common support plates 7' and 8' are connected to horizontal pipes 7'' and 8'' to form upper and lower common slide members 7 and 8. The horizontal pipes 7" and 8" slidably receives therein horizontal guide rods 5 and 6. The upper guide rod 5 is secured with the frame 1 at both ends, and the lower guide rod 6 is vertically movably supported at a lower portion of the frame 1 along vertical guide rods 11 as shown in FIG. 7. The upper and lower horizontal pipes are connected to each other by a connecting bar 9. Thus, a movable display sheet 12 is formed. The connecting bar 9 is formed by an upper bar 9" and a lower bar 9' which are slidably relative to each other to extend or contract. The six insert sheets 4 are stacked as shown in FIGS. 3 and 4, the same number of the guide rods 5 and 6, and the common slide members 7 and 8 and connecting bars 9 are arranged in the frame 1. On the rear side of the frame 1, support bars 13 connect upper and lower ends of the frame 1. A reversible reduction blake motor 14 is mounted on the support bar 13 and has an output shaft with a drive pinion which meshes with a horizontal rack 15. One end of the rack 15 is connected to the connecting bar 9 to form a reciprocating drive apparatus 16 of the movable display sheet 12. The other end of the rack 15 has a projection 17 which actuates a reciprocation switching limit switch 18. The ON-and-OFF operation of the limit switch 18 actuates a relay 19 which operates the drive motor 14 to move in the desired direction. The reciprocation drive apparatus 16 is mounted for driving each movable display sheet 12 so that there are six drive apparatus in the illustrated embodiment as shown in FIGS. 7 and 9. A microcomputor device 20 mounted on the frame 1 stores an operation program 23 of the six apparatus 16 and operates the six apparatus 16 sequentially according to the stored program 23 so that display on the front surface of the six sheets 4 are sequentially projected from the slits 3. Consequently, very remarkable display can be performed.

Figure 11:
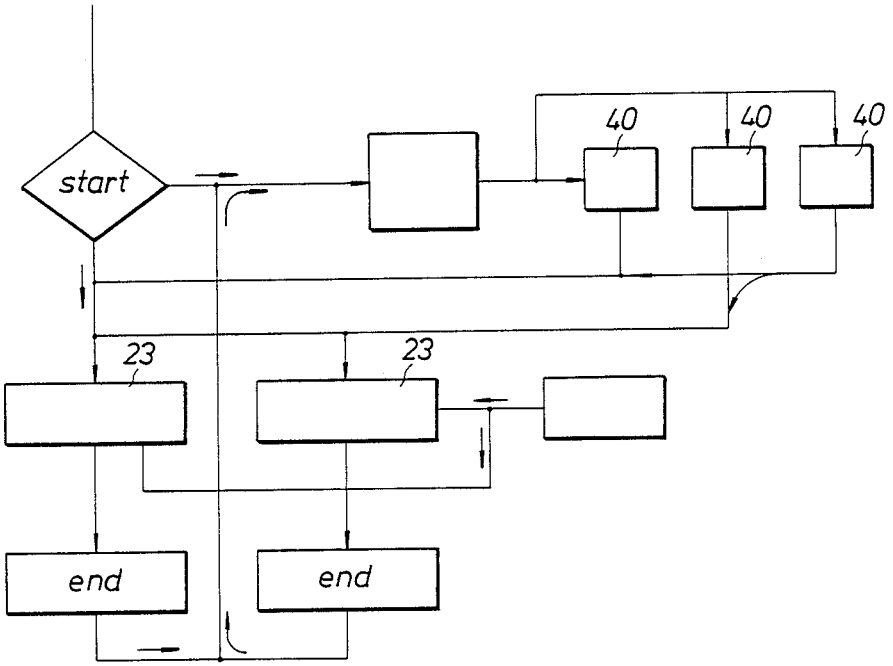
FIG. 11 is a flow chart of the control program.

The projecting movement and stop period of the insert sheet 4 can be set by timer means. Further, voice or musical display means may be combined with one or more insert sheets 4. FIG. 11 shows an example of a flow chart of the programmed movable display sheets 12, in which manually operable programs select switches 40 increase flexibility of the apparatus.

Downwardly urging springs 22 hold the lower horizontal guide rods 6. By supporting the lower guide rod 6 in free hanging state without securing with the frame 1, difference of the length of the insert sheets 4 can be easily adjusted without causing sag or excessive tightness.

The upper and lower common support members 6 may be made of a thin stainless steel plate to support insert sheet made of fabric. The both end portions of the sheet 4 may be formed by a portion of the steel plate having a integral narrow portion.

I claim:

1. A display apparatus having a display surface which can be changed to indicate a plurality of different displays, including a stationary display sheet having a plurality of slits disposed in parallel to and equally spaced from each other, a plurality of guide leaves, each extending from one side edge of each slit in spaced relation to a rear surface portion of the sheet extending from the other side edge of each slit, at each one insert sheet disposed between the rear surface portion of the display sheet and the guide leaf, means connected to upper and lower ends of said insert sheet to form a movable display sheet, means for slidably supporting said movable display sheet on a rear side of the stationary display sheet, and means for projecting and retracting a portion of the insert sheet through each slit to change the surface display, the improvement comprising:

said insert sheet having a width more than twice the width between the adjacent slits;

the means connected to upper and lower ends of the insert sheet including upper and lower support members connected to a half-duplicated insert sheet through narrow neck portions thereof;

a first guide rod secured to the stationary display sheet for guiding the upper support member; and a second guide rod spring-biased relative to the first guide rod for guiding the lower support member.

2. A display apparatus according to claim 1 including; a linear motor for driving the movable display sheet to and fro; and a limit switch for controlling the linear displacement of the linear motor.

3. A display apparatus comprising: a stationary display member having a front face provided with a display scene, a rear face and a plurality of slots communicating between the front and rear faces, the slots being disposed parallel to and equally spaced a given interval from each other; a plurality of movable display members provided with different display scenes and movably mounted on the rear face of the stationary display member, each movable display member being comprised of a plurality of segments successively disposed on one another in a partially overlapped relation with respect to one another and a pair of upper and lower support members for supporting therebetween the plurality of segments, each segment having a width more than twice the interval of the slots such that about half of each segment is covered by an adjacent segment and the remaining portion of each segment is uncovered by an adjacent segment and is provided with a part of the display scene, the uncovered segment portions being slidably inserted into the respective ones of the slots; mounting means for slidably mounting the plurality of movable display members, the mounting means including a plurality of upper guide rods fixed to the rear face of the stationary display member for guiding the respective upper support members during the sliding movement thereof, and a plurality of lower guide rods resiliently mounted on the rear face of the stationary display member and movable in a direction transverse to the sliding movement of the movable display members for adjustably guiding the respective lower support members during the sliding movement thereof; and driving means for independently driving each of the movable display members to project the uncovered segment portions from the slots to conceal the front face of the stationary display member and to expose the uncovered segment portions.

4. A display apparatus according to claim 3; wherein the stationary display member comprises a plurality of sections partly overlapped with one another in a spaced relation to one another to define a plurality of slots between adjacent sections.

5. A display apparatus according to claim 3; wherein each segment has a pair of upper and lower necked end portions connected to the upper end and lower support members, respectively.

6. A display apparatus according to claim 3; wherein the driving means comprises a linear motor for effecting the sliding movement of the movable display member, and a limit switch for controlling the linear motor.

* * * * *